US006537105B2

(12) United States Patent
Higashida et al.

(10) Patent No.: US 6,537,105 B2
(45) Date of Patent: Mar. 25, 2003

(54) ELECTRICAL CONNECTION BOX

(75) Inventors: Yasushi Higashida, Tokyo (JP); Tomotaka Watanabe, Tokyo (JP)

(73) Assignee: The Furukawa Electric Co., Ltd. (JP)

( * ) Notice: Subject to any disclaimer, the term of this patent is extended or adjusted under 35 U.S.C. 154(b) by 0 days.

(21) Appl. No.: 10/013,104

(22) Filed: Nov. 6, 2001

(65) Prior Publication Data

US 2002/0049002 A1 Apr. 25, 2002

Related U.S. Application Data

(63) Continuation of application No. PCT/JP00/01578, filed on Mar. 15, 2000.

(51) Int. Cl.[7] ..... H01R 13/60

(52) U.S. Cl. ..... 439/528; 439/76.2; 439/681; 439/924.2

(58) Field of Search ..... 439/680, 681, 439/148, 76.2, 528, 34, 139, 140, 144, 218, 924.2; 174/50

(56) References Cited

U.S. PATENT DOCUMENTS

| | | | | | |
|---|---|---|---|---|---|
| 3,944,316 | A | * | 3/1976 | Newman | 439/625 |
| 4,258,970 | A | * | 3/1981 | Bourdon et al. | 439/149 |
| 4,343,522 | A | * | 8/1982 | O'Neil | 439/34 |
| 4,386,333 | A | * | 5/1983 | Dillan | 336/101 |
| 4,921,444 | A | * | 5/1990 | Cama | 439/528 |
| 5,501,605 | A | | 3/1996 | Ozaki et al. | |
| 5,822,189 | A | | 10/1998 | Isshiki | |
| 6,048,229 | A | * | 4/2000 | Lazaro, Jr. | 439/681 |
| 6,069,992 | A | * | 5/2000 | Hyzin | 385/55 |
| 6,089,908 | A | * | 7/2000 | Huang | 439/528 |
| 6,332,788 | B1 | * | 12/2001 | Okabe et al. | 439/157 |
| 6,354,846 | B1 | * | 3/2002 | Murakami | 439/76.2 |

FOREIGN PATENT DOCUMENTS

| | | |
|---|---|---|
| JP | 9-55047931 | 4/1980 |
| JP | 9-070121 | 3/1997 |
| JP | 9-215154 | 8/1997 |

* cited by examiner

*Primary Examiner*—Tho D. Ta
*Assistant Examiner*—Larisa Tsukerman
(74) *Attorney, Agent, or Firm*—Knobbe, Martens, Olson & Bear, LLP

(57) ABSTRACT

An electrical connection box (1) is provided with a unit housing (11) for holding an electrical-part mounted unit (21) that is selectively attached thereto in accordance with specifications of the connection box, and a dummy connector housing (12) arranged adjacent to the unit housing. When the unit is not attached to the connection box, a connector (22) of a wire harness, which connector is employed for connection of the unit, can be fitted to the dummy connector housing. When the unit is attached, a free end of a flexible piece (17), which is formed integrally with a partition wall arranged at a location where the two housings (11, 12) are adjoined to each other, is displaced by the unit (21) into the dummy connector housing to thereby prevent the wire harness connector (22) from being fitted to the dummy connector housing, and the connector (22) becomes connectable to the connector of the unit (21). This arrangement prevents mistaken connection of the wire harness connector in the case of using a sharable wire harness of a type not provided with a tape-insulated connector.

11 Claims, 6 Drawing Sheets

ELECTRICAL CONNECTION BOX

RELATED APPLICATION

This application claims priority to and is a continuation of which incorporates by reference, in its entirety, International Application PCT/JP00/01578, filed Mar. 15, 2000, which was not published in English.

TECHNICAL FIELD

The present invention relates to an electrical connection box, and more particularly, to a vehicular electrical connection box adapted to be selectively attached with an electrical-part mounted unit and enabling a worker to accurately and quickly connect and fit a sharable wire harness at different connecting and fitting locations depending on whether an electrical-part mounted unit has been attached to the connection box.

BACKGROUND ART

In recent years, the need for comfort in automobiles has been rising. To satisfy such a need, the general practice has been to provide individual vehicles with options, such as audio systems, navigation systems, television sets, power antennas, air-conditioners, rear window heaters, seat heaters, power seats, suspension hardness control units, and various other electrical components, in accordance with types of vehicles or, even with the same type, in accordance with grades of vehicles.

The wiring for connecting such electrical components with the battery or controller is complicated. Wire harnesses or cables extending from the electrical components, battery, and controller are generally connected to an electrical connection box so as to accurately and simply establish electrical connections between these vehicle-mounted components. Various electrical parts are mounted in the electrical connector box. For example, a fuse is mounted to prevent overcurrent at the time of a short-circuit between a wire harness and a vehicle body or at the time of breakdown of a motor or other electrical component, and a relay is mounted, which cooperates with the operating switch of the electrical component to establish and break a power feed route to an electrical component.

In the case of a vehicle equipped with a large number of electrical components, sometimes an ACG control unit for continuously detecting the amount of power consumed by the electrical components and for controlling the engine speed in accordance with a change in the amount of power consumption is provided in the electrical connection box. In a vehicle equipped with a large number of electrical components, if many of the electrical components are operated at one time, the power consumption increases, the load on the battery rises, and the performance of the electrical components sometimes are lowered, but by controlling the engine speed to one suitable for the power consumption by using the ACG controller, the large number of electrical components can be operated stably.

The ACG control unit attached to the electrical connection box is connected to an engine speed sensor and an engine controller via wire harnesses. Therefore, the manner of wiring in the vehicle differs depending on whether an ACG control unit (more generally, an electrical-part mounted unit) is attached to the electrical connection box. Accordingly, the specifications of the wire harness sometimes vary in accordance with the presence/absence of an ACG control unit. That is, the provision is made of a wire harness having a connector 122 for connection of the ACG control unit (shown at right side in FIG. 5B) and a wire harness not provided with a connector 122 as shown by the two-dot chain line at the right side of FIG. 5A. These two types of wire harnesses are selectively used in accordance with whether the ACG control unit is attached to the connection box. In this case, the types of the wire harnesses increase and the cost rises.

In FIG. 5A and FIG. 5B, reference numeral 111 denotes an ACG control unit holder of the electrical connection box, which holder is formed with a fitting hole 111*a* into which the ACG control unit 121 having the connector 121*c* is fitted.

To avoid increased cost caused by the increase in the number of types of wire harnesses, sometimes a wire harness with a tape-insulated connector, serving as a sharable wire harness, is used irrespective of whether an ACG control unit is attached to the electrical connection box. As shown at the right side of FIG. 6A, a wire harness of this kind is provided with a connector 222 employed for connection of the ACG control unit, which connector is covered by an electrically insulating plastic tape 222*a*. By peeling off the insulating tape 222*a* from the connector 222, the connector 122 can be connected to a connector of the ACG control unit 121 (FIG. 6B) fitted to the fitting hole 111*a* of the unit holder 111 of the electrical connection box. On the other hand, when the ACG control unit 121 is not attached to the unit holder 111 of the electrical connection box (shown by the two-dot chain line at the left side of FIG. 6A), it is possible to leave the connector 222 of the wire harness unused in the covered and insulated state (shown at the right side in FIG. 6A).

Since the wire harness of this kind is suitably useable for both the state where the ACG control unit (FIG. 6B) is attached to the connection box and the state where it is not attached thereto (FIG. 6A), such a wire harness may be used as a sharable wire harness to reduce the number of types of wire harnesses. However, to connect the ACG control unit with this wire harness, the extra step of work of peeling off the insulating tape 222*a* of the connector 222 is required, as shown in FIG. 6B.

To eliminate such inconvenience, it may be considered to form a dummy connector housing near the ACG control unit holder of the electrical connection box. With an electrical connection box of this configuration, it would be possible to fit the wire harness connector to the dummy connector housing when the ACG control unit is not attached to the connection box, while it would be possible to connect the wire harness connector to the connector of the ACG control unit when the ACG control unit is attached thereto. That is, by using a combination of an electrical connection box provided with a dummy connector housing and a wire harness with a connector, a sharable wire harness can be provided, and there is no need to electrically insulate the connector, whereby the labor involved in peeling off the covering tape can be eliminated.

According to the electrical connection box of this configuration, however, even if an ACG control unit (more generally, an electrical-part mounted unit) is attached to the electrical connection box, a worker is liable to mistakenly end up fitting the wire harness connector to the dummy connector housing. In this case, the ACG control unit is not electrically connected with the wire harness, and therefore, the electrical connection box is end up being assembled in a state where the functions of the control unit are prevented from becoming effective. If the electrical connection box assembled with the wire harness connector mistakenly connected in this way were mounted in a vehicle, the mistaken connection would not be discovered before the final inspection line of the vehicle assembly line and the subsequent work for correction would become complicated.

DISCLOSURE OF THE INVENTION

An object of the present invention is to provide an electrical connection box adapted to be selectively attached with an electrical-part mounted unit and enabling a sharable wire harness to be quickly and accurately connected and held at a different connecting and holding location depending on whether the electrical-part mounted unit is attached to the connection box, the sharable wire harness being suitable for use in both the state where the electrical-part mounted unit is attached to the connection box and the state where the unit is not attached.

To achieve the above object, the electrical connection box according to the present invention comprises a unit holder to which an electrical-part mounted unit is adapted to be attached, a dummy connector housing adapted to be fitted with a connector of a wire harness, which connector is employed for connection of the electrical-part mounted unit, and blocking means for preventing the connector from being fitted to the dummy connector housing in a state where the electrical-part mounted unit is attached to the unit holder.

According to the present invention, an ACG control unit or other electrical-part mounted unit can be selectively attached to the electrical connection box, and the wire harness connector can be connected or held without mistake regardless of whether the electrical-part mounted unit is attached to the connection box. That is, in a state where the electrical-part mounted unit is attached to the electrical connection box, the blocking means prevents the wire harness connector from being fitted to the dummy connector housing of the electrical connection box, so that the connector cannot be mistakenly fitted to the dummy connector housing by a worker, whereas the connector is connectable to the electrical-part mounted unit. Thus, the worker accurately connects the connector to the electrical-part mounted unit attached to the electrical connection box. In a state where no electrical-part mounted unit is attached to the electrical connection box, the worker is not permitted to connect the wire harness connector to the electrical-part mounted unit, whereas the connector can be fitted to the dummy connector housing of the electrical connection box. Thus, the wire harness connector is accurately held in the dummy connector housing. In this way, according to the present invention, mistaken connection and mistaken fitting of the wire harness to the electrical connection box can be reliably prevented, thereby making it possible to eliminate the work of inspection for mistaken connection and mistaken fitting and the work of correction.

In the present invention, a wire harness is employed, which is provided with a connector adapted to be connected to the electrical-part mounted unit and to be fitted to the dummy connector housing. This wire harness can be used in common for both the state where the electrical-part mounted unit is attached to the electrical connection box and the state where no electrical-part mounted unit is attached thereto. Since the wire harness is sharable between these states as mentioned in the above, there is no need to selectively use wire harnesses of different specifications in accordance with whether the electrical-part mounted unit is attached, so that the types of the wire harnesses can be decreased, and a contribution to a reduction of costs can be attained.

In addition, there is no need to cover the wire harness connector for insulation. That is, if the dummy connector housing is made from an electrically insulating material, when the wire harness connector is fitted to the dummy connector housing, the connector is insulated from electrical parts located inside and outside of the electrical connection box and from the vehicle body and other conductors. Since the connector does not have to be covered for insulation, there is no need of peeling off an insulating tape from the connector before the wire harness is connected with the electrical-part mounted unit, and therefore, an improvement of the efficiency of the wire harness connection work and a reduction in the number of assembly steps of the electrical connection box can be achieved. This contributes to the reduction of costs.

In the present invention, preferably, the blocking means is comprised of a flexible piece that is formed in the unit holder so as to be able to interact with the electrical-part mounted unit. The flexible piece is displaced, due to interaction between itself and the electrical-part mounted unit, from a first position allowing the connector to be fitted to the dummy connector housing to a second position preventing the connector from being fitted thereto.

With this preferred embodiment, mistaken connection and mistaken fitting of the wire harness connector can be reliably prevented by a simple configuration. That is, if no electrical-part mounted unit is attached to the electrical connection box, the flexible piece cannot interact with the electrical-part mounted unit, so that it assumes the first position. In this case, the flexible piece does not achieve the function of preventing the fitting of the connector, and the electrical-part mounted unit is not attached. Thus, the wire harness connector is connected to the dummy connector housing. On the other hand, if an electrical-part mounted unit is attached to the electrical connection box, the flexible piece is displaced from the first position to the second position due to interaction between itself and the electrical-part mounted unit and achieves the function of preventing the fitting of the connector. That is, the flexible piece prevents the wire harness connector from being fitted to the dummy connector housing, and hence a worker will not mistakenly fit the connector to the dummy connector housing, so that the wire harness connector is connected to the electrical-part mounted unit.

More preferably, the unit holder of the electrical connection box defines a unit fitting space in which the electrical-part mounted unit tightly fits. The dummy connector housing is provided adjacent to the unit holder and defines a connector fitting space in which the connector of the wire harness tightly fits. The flexible piece has a proximal end and a free end. At a location where the unit holder adjoins to the dummy connector housing, the proximal end of the flexible piece is formed integrally with the unit holder. When the flexible piece is at the second position, the free end is displaced into the connector fitting space of the dummy connector housing to thereby prevent the connector from being fitted into the connector fitting space. The flexible piece has an inclined portion on the side of the unit fitting space between the proximal end and the free end. When the flexible piece is at the first position, the inclined portion projects into the unit fitting space. The degree of projection is larger on the free end side.

According to this preferred embodiment, the flexible piece can be formed relatively easily, e.g., by making two cuts in a partition wall between the unit holder and the dummy connector housing. The flexible piece may be provided so as to be able to interact with the electrical-part mounted unit. Further, it is possible to selectively prevent the wire harness connector from being fitted to the dummy connector housing depending on whether the electrical-part mounted unit is attached to the unit holder. That is, if the electrical-part mounted unit is fitted into the unit fitting space of the unit holder, the unit abuts against the inclined portion of the flexible piece located at the first position. If the electrical-part mounted unit is fitted further deeply, the flexible piece is displaced from the first position to the second position by the unit, and the free end of the flexible piece projects into the connector fitting space of the dummy connector housing, thereby preventing the connector from being fitted to the connector fitting space.

In another preferred embodiment of the present invention, the unit holder and the dummy connector housing are arranged adjacent to each other. The unit holder defines a unit fitting space in which the electrical-part mounted unit tightly fits, while the dummy connector housing defines a connector fitting space in which the connector of the wire harness tightly fits. At a location where the unit holder and the dummy connector housing adjoin to each other, the unit fitting space and the connector fitting space are communicated with each other and partially overlap one another at an overlapping space. When the electrical-part mounted unit is fitted into the unit fitting space, the overlapping space is occupied by a corresponding portion of the electrical-part mounted unit. The corresponding portion of the electrical-part mounted unit forms the blocking means in cooperation with the overlapping space defined by the unit holder and dummy connector housing.

When the electrical-part mounted unit is attached to the unit holder of the electrical connection box according to this preferred embodiment, part of the unit occupies the overlapping space, that is, part of the connector fitting space of the dummy connector housing, so that the connector will not be mistakenly fitted in the dummy connector housing by a worker and the connector will be reliably connected to the electrical-part mounted unit.

Preferably, the unit holder has at one side a first opening into which the electrical-part mounted unit can be inserted and has at the side opposite to the first opening a second opening and a locking portion with which the electrical-part mounted unit can abut. In this case, the electrical-part mounted unit can be reliably attached to the unit holder of the electrical connection box through the first opening and the wire harness connector can be easily connected to the electrical-part mounted unit through the second opening.

Preferably, a dummy connector adapted to be connected with the connector of the wire harness is arranged in the dummy connector housing. In this case, the wire harness connector can be reliably held by the dummy connector.

BEST MODE FOR WORKING THE INVENTION

In the following, an explanation will be made of an electrical connection box according to a first embodiment of the present invention with reference to FIG. 1 to FIGS. 3A and 3B.

Figure 1:
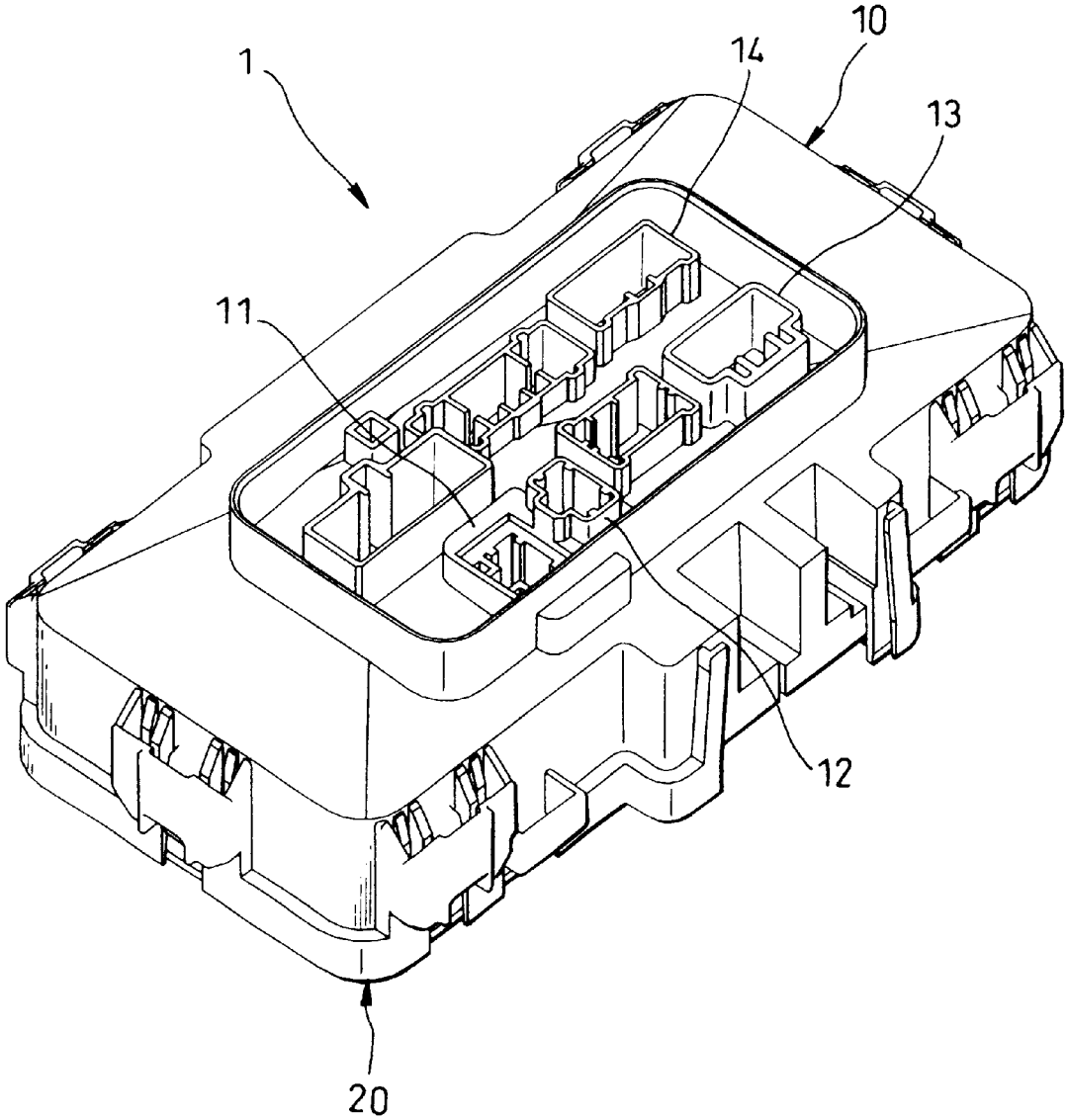
FIG. 1 is a perspective view of an electrical connection box according to a first embodiment of the present invention seen from a lower case side in a state with a lower cover removed.

This electrical connection box 1 is provided with a lower case 10 and an upper cover 20 shown in FIG. 1. Further, it is provided with a lower cover (not shown) mated with the lower case 10 and an upper case (hidden and not visible in FIG. 1) to which the upper cover 20 is mated. A fuse, a relay, etc. (none of which is shown) are mounted in the upper case. Preferably, the lower case 10 is molded into one piece with use of a plastic material or other electrically insulating material. At the bottom (top in FIG. 1) of the lower case are formed a unit holder 11, a dummy connector housing 12, and a plurality of connectors 13, 14, . . . employed for connection of wire harnesses.

The electrical connection box 1, which is for example mounted in a vehicle equipped with electrical components, is used for electrically connecting these electrical components with the battery and various controllers (none of which is shown) of the vehicle. To this end, connectors (not shown)

attached to the distal ends of wire harnesses extending from the electrical components, battery, and controllers are adapted to be connected to connectors 13, 14 . . . of the electrical connection box 1.

Further, an electrical-part mounted unit, for example, an ACG control unit 21, is selectively mounted to the unit holder 11 of the electrical connection box 1. Here, the "ACG control unit 21", as explained above, means an electronic control unit outputting a control signal for changing the engine speed in accordance with a change in the amount of power consumption of the electrical components. The unit older 11 of the present embodiment is comprised of a unit housing that defines a unit fitting space in which the ACG control unit 21 tightly fits. Hereinafter, the unit holder will be referred to as the "ACG control unit holder" or "unit housing".

The unit housing 11 is formed at the upper case side (in FIG. 1, the bottom side, in FIG. 2B, the top side) with an opening into which the ACG control unit 21 can be inserted. The unit 21 can be inserted into the unit fitting space of the ACG control unit holder 11 through this opening. As shown in FIG. 3A, if the ACG control unit is completely inserted into the unit fitting space, the ACG control unit 21 is tightly received in the fitting space, and the distal end 21*a* of the ACG control unit abuts against the bottom wall (locking portion) 11*a* of the ACG control unit holder 11. In this state, the ACG control unit 21 is pressed by the holding lock 11*k* formed in the ACG control unit holder 11, so that the unit is firmly held.

For the connection between the ACG control unit 21 and the engine controller, sensor etc. (none of which is shown), a connector 21*c* to which the wire harness connector 22 can be connected is attached, as shown in the bottom view of FIG. 3A, to the distal end 21*a* of the ACG control unit 21, and a connector 22 for connection of the ACG control unit (FIGS. 2A, 3A, and 3B) is attached to the distal end of the wire harness extending from the engine controller or the like. Further, the bottom wall of the ACG control unit holder 11 is formed with an opening 11*b*. The wire harness connector 22 is designed to be connected through the bottom wall opening 11*b* of the unit housing 11 to the connector 21*c* of the ACG control unit 21 attached to the unit holder 11.

In the above configuration, when mounting the ACG control unit 21 to the electrical connection box 1, the upper case is fitted to the lower case 10, then the ACG control unit 21 is inserted into the ACG control unit holder 11. As a result, as shown in the bottom view of FIG. 3A, the connector 21*c* of the ACG control unit 21 appears at the opening 11*b* of the ACG control unit holder 11, so that the wire harness connector 22 may be connected to the connector 21*c*.

In the electrical connection box 1, a wire harness of the same specifications and not covered by an insulator is used regardless of whether the ACG control unit 21 is attached to the connection box. To use this type of wire harness without problem, the electrical connection box 1 is so designed that the connector 22, employed for connection of the ACG control unit, of the wire harness is held by a dummy connector housing 12 as shown in the sectional view of FIG. 2A when the ACG control unit 21 is not attached to the connection box.

As shown in FIG. 2A to FIG. 3B, the dummy connector housing 12 is provided adjacent to the ACG control unit holder 11 at the opening 11*b* side of the unit housing 11 and is designed to tightly receive the wire harness connector 22 in a connector receiving space of the connector housing. The unit housing 11 and the dummy connector housing 12 are formed integrally with the lower case 10 comprised of the electrical insulating material, so that the wire harness connector 22 attached to the dummy connector housing 12 is electrically insulated from electrical parts located inside and outside of the electrical connection box 1 and from the vehicle body and other conductors, whereby occurrence of overcurrent at the wire harness caused by short-circuits etc. between the connector 22 and the peripheral elements is reliably prevented.

Figure 2A:
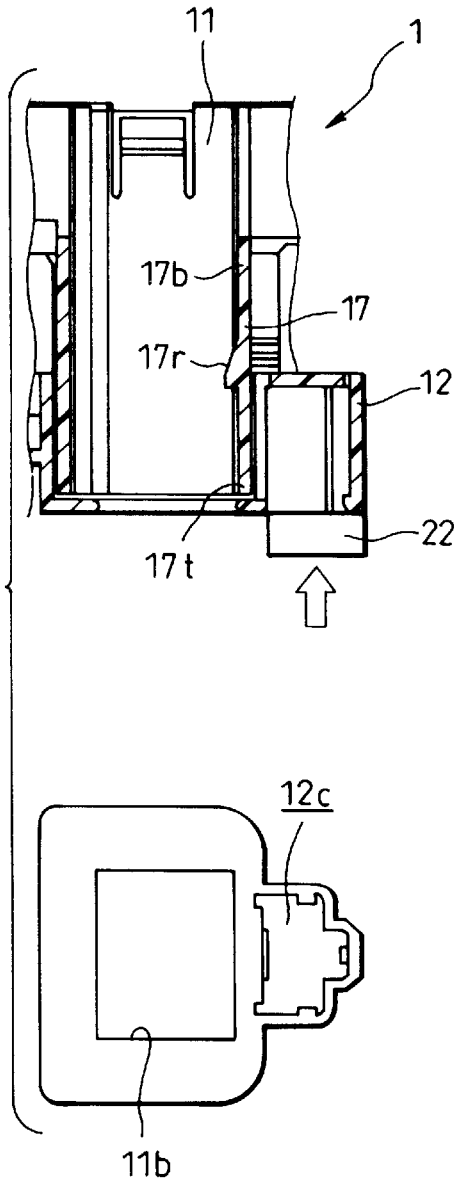
FIG. 2A is a partial sectional view and partial bottom view of an electrical connection box in a state where a wire harness connector can be completely attached to a dummy connector housing.

As is clear from the foregoing explanation, when the ACG control unit 21 is not attached to the electrical connection box 1, as shown in the bottom view of FIG. 2A, the connector 21*c* of the ACG control unit 21 does not appear at the opening 11*b* of the ACG control unit holder 11. Therefore, a worker will fit the wire harness connector 22 without mistake to the dummy connector 12*c* provided in the dummy connector housing 12, so that the problem of the wire harness being mistakenly connected will not arise.

On the other hand, when the ACG control unit 21 is attached to the electrical connection box 1, as shown in the bottom view of FIG. 3A, the wire harness connector 22 can be connected to both the connector 12*c* of the ACG control unit holder 11 and the connector 21*c* of the dummy connector housing 12, so that there is a fear that the wire harness is mistakenly connected.

In the present invention, blocking means is provided for preventing mistaken fitting of the wire harness connector 22 to the dummy connector housing 12 in a state where the ACG control unit 21 is attached to the connection box. In the electrical connection box 1 of the present embodiment, the blocking means is comprised of a flexible piece 17 shown in FIGS. 2A and 3A.

A partition wall is provided between the unit housing 11 and the dummy connector housing 12 at a location where the unit housing (ACG control unit holder) 11 adjoins to the dummy connector housing 12. For example, the flexible piece 17 is formed by making two cuts in the partition wall which extend in the longitudinal direction of the housing.

As shown in FIG. 2A to FIG. 3B, the flexible piece 17 has a proximal end 17*b* formed integrally with the partition wall and a free end 17*t* displaceable with respect to the wall. As viewed in the longitudinal direction of the unit housing 11 and the dummy connector housing 12, the proximal end 17*b* is positioned at an intermediate portion of the unit housing 11, while the free end 17*t* is positioned near the opening at the lower end of the dummy connector housing 12.

The flexible piece 17 is formed into a so-called lance shape and can interact with the ACG control unit 21 attached to the unit housing 11. More specifically, the inclined portion 17*r* is formed between the proximal end 17*b* and the free end 17*t* on that surface of the flexible piece 17 which is located on the ACG control unit side. The surface of the inclined portion 17*r* on the unit side slantingly extends from the proximal end 17*b* toward the free end 17*t*. The more to the free end 17*t*, the greater the projection of the unit housing 11 inward in the width direction.

The free end 17*t* of the flexible piece 17 can be displaced between the first position (FIG. 2A) allowing the wire harness connector 22 to be fitted to the dummy connector housing 12 and the second position (FIG. 3A) preventing the wire harness connector 22 from being fitted thereto. That is, the free end 17*t* is normally at the first position, but when the flexible piece 17 is urged toward the dummy connector housing by the distal end 21*a* of the ACG control unit 21 inserted into the unit housing 11, the free end is displaced from the first position to the second position.

In the following, an explanation will be made of the operation of the electrical connection box 1 according to the present embodiment.

In the case of a vehicle or an electrical connection box 1 having specifications not requiring attachment of an ACG control unit 21, that is, when the lower case 10, the upper case and upper cover 20 are assembled without the ACG control unit 21 attached, as shown in the bottom view of FIG. 2A, the connector 21*c* of the ACG control unit 21 will not appear at the opening 11*b* of the unit housing 11. Since the ACG control unit 21 is not inserted in the unit housing 11, the flexible piece 17 is at the first position, so that the flexible piece 17 does not exhibit the function of preventing the connector from being fitted, so that the dummy connector 12*c* of the dummy connector housing 12 can be used.

Therefore, when the ACG control unit 21 is not attached to the electrical connection box 1 adapted for use with the sharable wire harness that is always provided with the connector 22 employed for connection of the ACG control unit, the wire harness connector 22 can be fitted only to the dummy connector housing 12. This makes it possible to prevent the wire harness connector 22 from short-circuiting with peripheral elements, whereby a malfunction of the vehicular control system caused by the short-circuiting can be prevented.

Figure 2B:
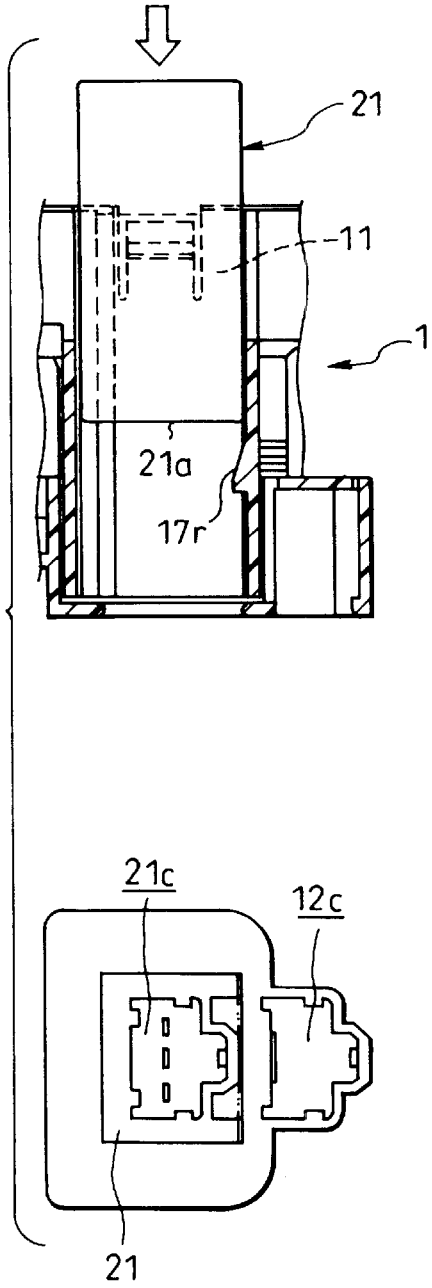
FIG. 2B is a partial sectional view and partial bottom view of an electrical connection box in a state with the ACG control unit attached halfway to the ACG control unit holder.
Figure 3A:
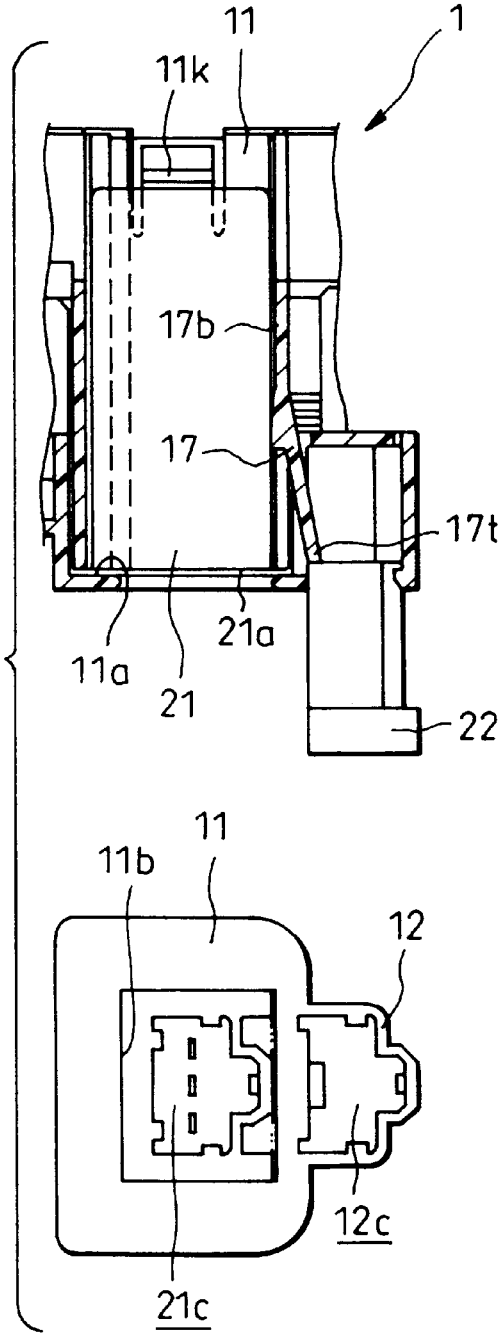
FIG. 3A is a partial sectional view and partial bottom view of an electrical connection box in a state where the wire harness connector is prevented from being fitted to the dummy connector housing by a flexible piece that is displaced by the ACG control unit attached to the ACG control unit holder.
Figure 3B:
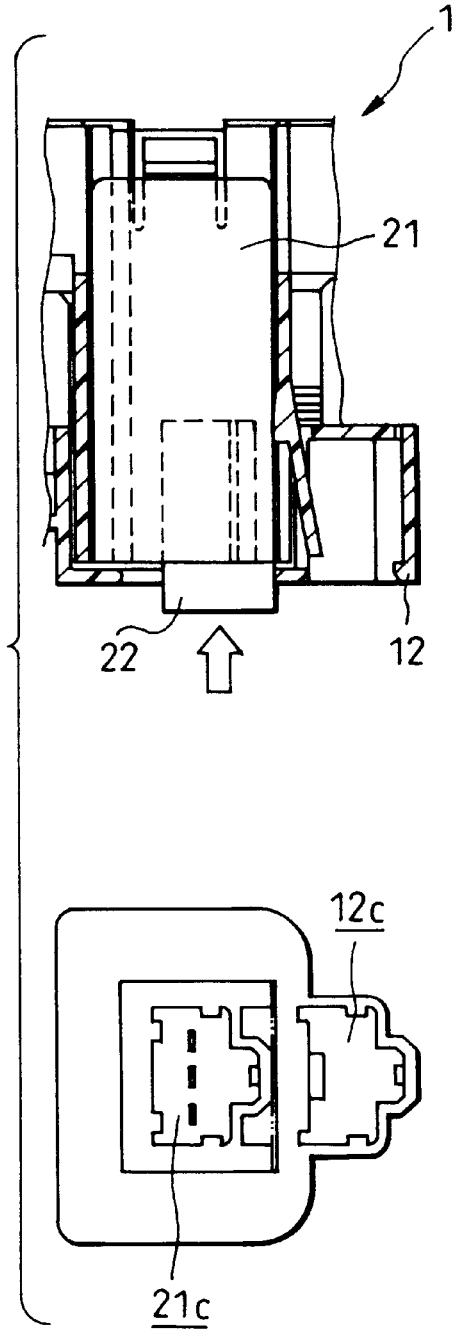
FIG. 3B is a partial sectional view and partial bottom view of an electrical connection box in a state where the wire harness connector is connected to the ACG control unit attached to the ACG control unit holder.

Next, in the case of an electrical connection box 1 of a specification requiring attachment of the ACG control unit 21, as shown in the sectional view of FIG. 2B, if the ACG control unit 21 is inserted into the unit housing 11, the distal end 21*a* of the unit 21 pushes the inclined portion 17*r* of the flexible piece 17 outwardly of the unit housing. Further, as shown in the sectional view of FIG. 3A, if the ACG control unit 21 is completely inserted in the unit housing 11, the free end 17*t* of the flexible piece 17 is displaced from the first position to the second position.

When the free end 17*t* of the flexible piece 17 takes the second position, the free end 17 prevents the wire harness connector 22 from being fitted to the dummy connector housing 12, so that a worker will not mistakenly fit the wire harness connector 22 to the dummy connector housing 12. On the other hand, the connector 21*c* of the ACG control unit 21 appears at the opening 11*b* of the unit housing 11. Therefore, as shown in the sectional view of FIG. 3B, the wire harness connector 22 is reliably connected to only the ACG control unit 21. As distinct from the case of using the aforesaid conventional wire harness with the tape-insulated connector, there is no need for the extra step of peeling off the insulating tape, so that the number of steps of the assembly work can be reduced, even if the connection box has a specification requiring the attachment of the ACG control unit.

Next, an explanation will be given of an electrical connection box according to a second embodiment of the present invention.

The electrical connection box 5 according to the present embodiment differs in the configuration of the blocking means compared with the first embodiment in which the flexible piece 17 constitutes the blocking means for preventing the fitting of the wire harness connector to the dummy connector housing in a state where the ACG control unit 21 is attached. That is, the electrical connection box 5 of the present embodiment is so configured that the inside spaces of the ACG control unit holder (unit housing) and the dummy connector housing partially overlap one another, and the function of preventing the connector fitting is achieved by permitting the ACG control unit 21 fitted in the unit fitting space of the unit housing to occupy part of the overlapping space, i.e., part of the connector fitting space of the dummy connector housing.

As for the other points, the electrical connection box 5 of the present embodiment is configured in substantially the same manner as the first embodiment. Common components are given corresponding reference numerals and detailed explanations thereof are omitted.

Next, an explanation will be made of the blocking means of the electrical connection box 5 of the present embodiment.

Figure 4A:
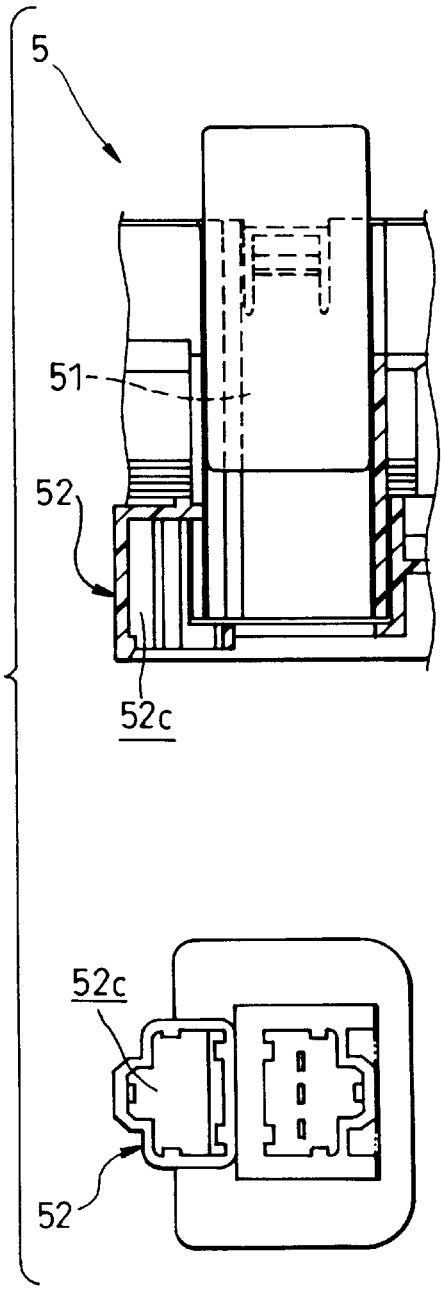
FIG. 4A is a partial sectional view and partial bottom view of an electrical connection box according to a second embodiment of the present invention in a state where the ACG control unit is attached halfway to the ACG control unit holder.

As shown in FIG. 4A, at a location where the ACG control unit holder (unit housing) 51 adjoins to the dummy connector housing 52, the ACG control unit fitting space of the unit housing 51 and the wire harness connector fitting space 52*c* of the dummy connector housing 52 are communicated with each other and partially overlap one another. Hereinafter, the overlapping portion of these spaces will be referred to as the overlapping space A.

In the electrical connection box 5 of the above configuration, if the ACG control unit 21 is not inserted into the unit housing 51, the connector 21*c* of the ACG control unit does not appear at the lower opening of the unit housing 51, so that the wire harness connector 22 (not shown in FIGS. 4A and 4B) cannot be connected to the connector 21*c*. On the other hand, the entirety of the connector fitting space of the dummy connector housing 52 can be used. Therefore, the wire harness connector 22 is connected to the dummy connector 52*c* of the dummy connector housing 52.

Figure 4B:
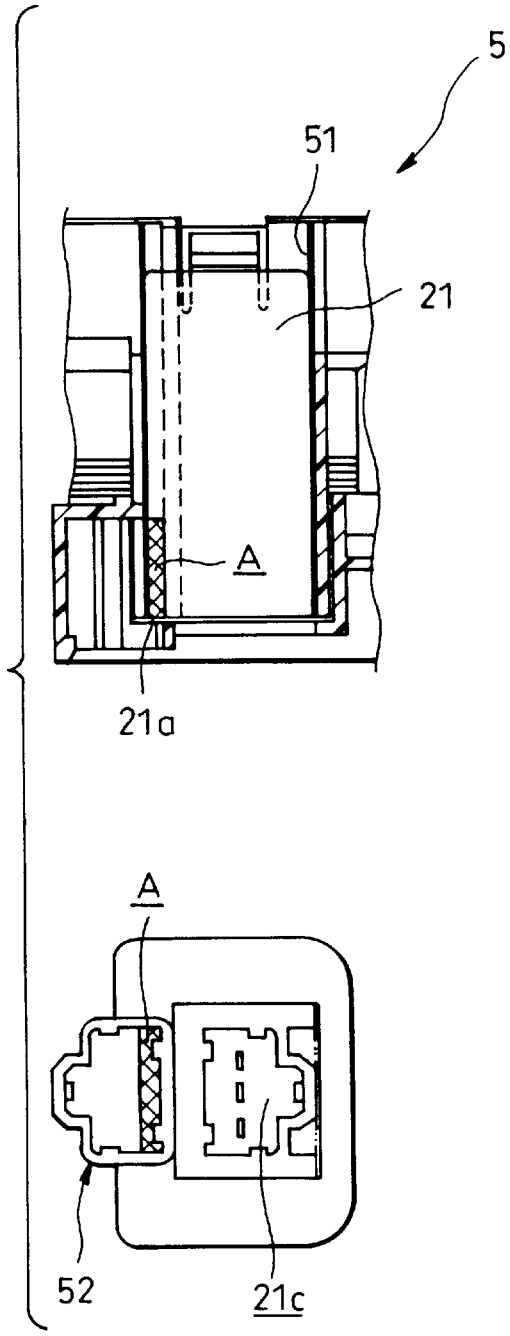
FIG. 4B is a partial sectional view and partial bottom view of an electrical connection box in a state where the wire harness connector is prevented from being fitted to the dummy connector housing by the ACG control unit attached to the ACG control unit holder.
Figure 5A:
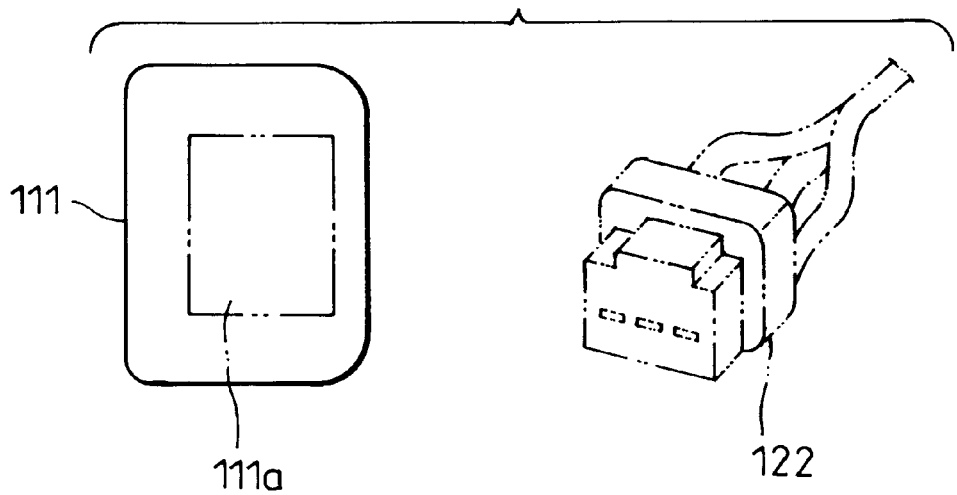
FIG. 5A is a bottom view of an ACG control unit holder of an electrical connection box to which the ACG control unit is not attached and a perspective view, showing by an imaginary line, of a connector employed for connection of the ACG control unit, which connector is not provided in a conventional wire harness for use with such an electrical connection box.
Figure 5B:
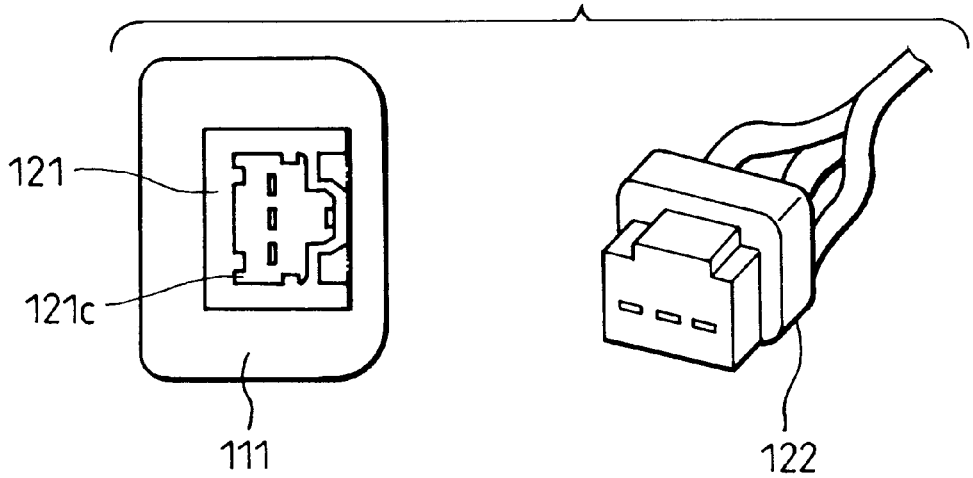
FIG. 5B is a bottom view of an ACG control unit holder of an electrical connection box to which the ACG control unit is attached and a perspective view of a connector employed for connection of an ACG control unit, which connector is provided in a conventional wire harness for use with such an electrical connection box.
Figure 6A:
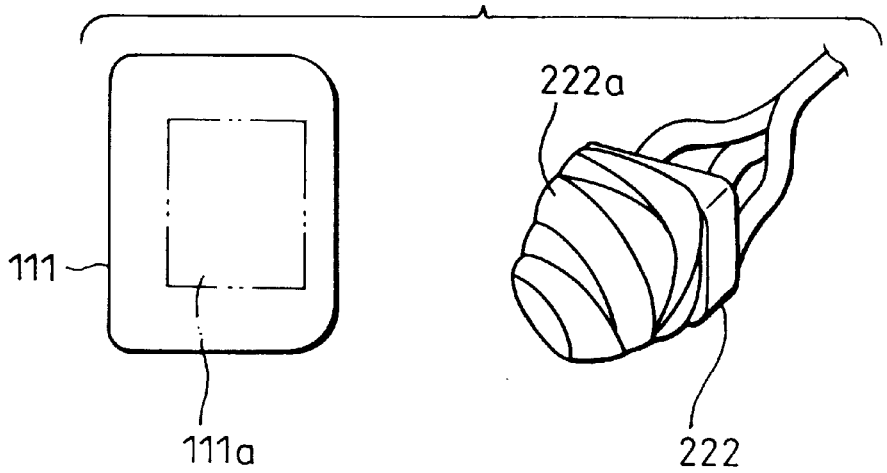
FIG. 6A is a bottom view of an ACG control unit holder of an electrical connection box to which the ACG control unit is not attached and a perspective view showing, in a state covered by an insulating tape, a connector employed for connection of the ACG control unit, which connector is provided in a conventional wire harness for use with such an electrical connection box.
Figure 6B:
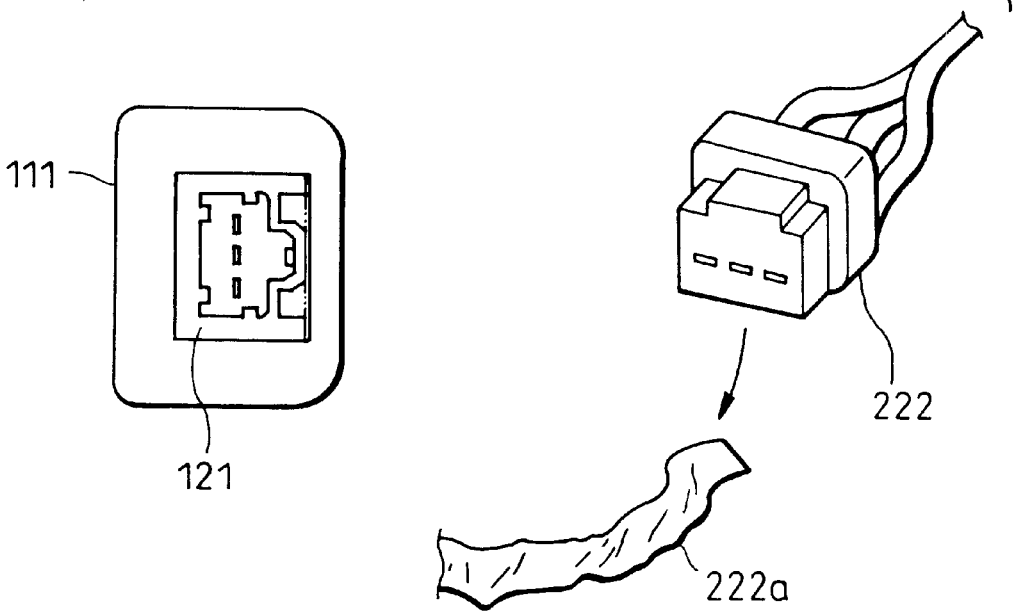
FIG. 6B is a bottom view of an ACG control unit holder of an electrical connection box to which the ACG control unit is attached and a perspective view showing a wire harness, shown in FIG. 6A, in a state with the insulating tape peeled off from the connector.

In case that the ACG control unit 21 is inserted into the unit housing 51, the connector fitting space in the dummy connector housing 52 is still retained when the ACG control unit 21 is inserted halfway into the unit housing 51, as shown in FIG. 4A. However, if the ACG control unit 21 is completely inserted into the unit housing 51, the overlapping space A shown by hatching in FIG. 4B is occupied by the ACG control unit 21. As a result, if an attempt is made to cause the wire harness connector 22 to be fitted to the dummy connector housing 52, the wire harness connector 22 interferes with a distal end portion, i.e., a bottom end portion 21*a* of the ACG control unit 21, so that the connector fitting is blocked. On the other hand, the connector 21*c* of the ACG control unit 21 appears at the lower opening of the unit housing 51 and is available for use.

Therefore, the wire harness connector 22 can be connected to only the connector 21*c* of the ACG control unit 21, making it possible to effectively prevent mistaken fitting of the wire harness connector 22 to the dummy connector housing 52 in the electrical connection box 5 having a specification requiring the provision of the ACG control unit. Therefore, it becomes possible for an assembly worker to reliably connect the wire harness connector 22 to the ACG control unit 21 by manual work without making visual observations.

The present invention is not limited to the foregoing first and second embodiments, and various modifications thereof may be made.

For example, in the electrical connection box 1 of the first embodiment having the dummy connector 12 provided in the connector fitting space of the dummy connector housing 12, if the ACG control unit 21 is not attached to the electrical connection box 1, the connector 22 for connection of the ACG control unit of the wire harness is connected to the dummy connector 12*c*. However, it is not essential to provide the dummy connector 12*c* in the dummy connector housing 12. It is sufficient that the dummy connector housing 12 can fittedly hold the wire harness connector 22 in such a manner that the connector 22 is not easily detached therefrom. The same applies to the electrical connection box 5 of the second embodiment.

In the first and second embodiments, the dummy connector housings 12 and 52 are comprised of electrical insulating materials, but the inside surfaces of the dummy connector housings may be covered by electrical insulating materials instead of using such housings or in combination therewith.

Further, detailed configurations of the electrical connection box can be modified. For example, the outside shape of the ACG control unit 21 or wire harness connector 22 and the inside shape of the unit housing 11 or dummy connector housing 12 are not limited to the rectangular sectional shape in the embodiments. Furthermore, the relative arrangement of the unit housing 11 and the dummy connector housing 12 is not limited to that of the embodiment where the dummy connector housing 12 is arranged on the long side of the unit housing 11 having a rectangular sectional shape.

In the above embodiments, explanations have been given of a vehicular electrical connection box to which an electronic control unit for control of the engine speed (ACG control unit) is selectively attached. However, the electrical connection box of the present invention may be equipped with an electrical-part mounted unit other than an ACG control unit and may be applied to a field of application other than a vehicle.

What is claimed is:

1. An electrical connection box comprising:

a unit holder to which an electrical-part mounted unit is adapted to be attached:

a dummy connector housing adapted to be fitted with a connector of a wire harness, the connector being employed for connection of the electrical-part mounted unit; and blocking means, activated in response to the attachment of the unit, for preventing the connector from being fitted to said dummy connector housing in a state where the electrical-part mounted unit is completely attached to said unit holder wherein the connector is connected to the electrical part mounted unit.

2. The electrical connection box according to claim 1, wherein:

said blocking means is comprised of a flexible piece that is formed in said unit holder so as to be able to interact with the electrical-part mounted unit, and the flexible piece is displaced due to interaction between itself and the electrical-part mounted unit, from a first position allowing the connector to be fitted to said dummy connector housing to a second position preventing the connector from being fitted thereto.

3. The electrical connection box according to claim 2, wherein:

said unit holder of said electrical connection box defines a unit fitting space in which the electrical-part mounted unit tightly fits, said dummy connector housing is provided adjacent to the unit holder and defines a connector fitting space in which the connector of the wire harness tightly fits, the flexible piece has a proximal end and a free end, the proximal end of the flexible piece being formed integrally with said unit holder at a location where said unit housing adjoins to said dummy connector housing, and the free end being displaced into the connector fitting space of said dummy connector housing to thereby prevent the connector from being fitted into the connector fitting space when the flexible piece is at the second position, and the flexible piece has a inclined portion on a side of the nit fitting space between the proximal end and the free end, the inclined portion projecting into the unit fitting space when the flexible piece is at the first position, and a degree of projection being larger on a free end side.

4. The electrical connection box according to claim 1, wherein:

said unit holder and said dummy connector housing are arranged adjacent to each other, said unit holder defining a unit fitting space in which the electrical-part mounted unit tightly fits, said dummy connector housing defining a connector fitting space in which the connector of the wire harness tightly fits, the unit fitting space and the connector fitting space being communicated with each other and partially overlapping one another at an overlapping apace at a location where said unit holder and said dummy connector housing adjoin to each other;

the overlapping space is occupied by a corresponding portion of the electrical-part mounted unit when the electrical-part mounted unit is fitted into the unit fitting space; and the corresponding portion of the electrical-part mounted unit forms said blocking means in cooperation with the overlapping space.

5. An electrical connection box comprising:

a unit holder to which an electrical-part mounted unit is adapted to be attached:

a dummy connector housing adapted to be fitted with a connector of a wire harness, the connector being employed for connection of the electrical-part mounted unit; and blocking means for preventing the connector from being fitted to said dummy connector housing in a state where the electrical-part mounted unit is completely attached to said unit holder, wherein the connector is connected to the electrical part mounted unit wherein said blocking means is comprised of a flexible piece that is formed in said unit holder so as to be able to interact with the electrical-part mounted unit, and the flexible piece is displaced, due to interaction between itself and the electrical-part mounted unit, from a first position allowing the connector to be fitted to said dummy connector housing, to a second position preventing the connector from being fitted thereto.

6. An electrical connection box comprising:

a unit holder to which an electrical-part mounted unit is adapted to be attached:

a dummy connector housing adapted to be fitted with a connector of a wire harness, the connector being employed for connection of the electrical-part mounted unit; and blocking means for preventing the connector from being fitted to said dummy connector housing in a state where the electrical-part mounted unit is completely attached to said unit holder, wherein the connector is connected to the electrical part mounted unit wherein said unit holder of said electrical connection box defines a unit fitting space in which the electrical-part mounted unit tightly fits, wherein said dummy connector housing is provided adjacent to the unit holder and defines a connector fitting space in which the connector of the wire harness tightly fits, wherein the flexible piece has a proximal end and a free end, the proximal end of the flexible piece being formed integrally with said unit holder at a location where said unit housing adjoins to said dummy connector housing, and the free end being displaced into the connector fitting space of said dummy connector housing to thereby prevent the connector from being fitted into the connector fitting space when the flexible piece is at the second position, and wherein the flexible piece has a inclined portion on a side of the nit fitting space between the proximal end and the free end, the inclined portion projecting into the unit fitting space when the flexible piece is at the first position, and a degree of projection being larger on a free end side.

7. An electrical connection box comprising:

a unit holder to which an electrical-part mounted unit is adapted to be attached:

a dummy connector housing adapted to be fitted with a connector of a wire harness, the connector being employed for connection of the electrical-part mounted unit; and blocking means for preventing the connector from being fitted to said dummy connector housing in a state where the electrical-part mounted unit is completely attached to said unit holder wherein the connector is connected to the electrical part mounted unit, wherein said unit holder and said dummy connector housing are arranged adjacent to each other, said unit holder defining a unit fitting space in which the electrical-part mounted unit tightly fits, said dummy connector housing defining a connector fitting space in which the connector of the wire harness tightly fits, the unit fitting space and the connector fitting space being communicated with each other and partially overlapping one another at an overlapping apace at a location where said unit holder and said dummy connector housing adjoin to each other;

the overlapping space is occupied by a corresponding portion of the electrical-part mounted unit when the electrical-part mounted unit is fitted into the unit fitting space; and the corresponding portion of the electrical-part mounted unit forms said blocking means in cooperation with the overlapping space.

8. An electrical connection box comprising:

a unit holder to which an electrical-part mounted unit is adapted to be attached:

a dummy connector housing adapted to be fitted with a connector of a wire harness, the connector being employed for connection of the electrical-part mounted unit; and a blocker, activated in response to the attachment of the unit, for preventing the connector from being fitted to said dummy connector housing in a state where the electrical-part mounted unit is completely attached to said unit holder wherein the connector is connected to the electrical part mounted unit.

9. The electrical connection box according to claim 8, wherein:

said blocking member comprises a flexible piece that is formed in said unit holder so as to be able to interact with the electrical-part mounted unit, and the flexible piece is displaced, due to interaction between itself and the electrical-part mounted unit, from a first position allowing the connector to be fitted to said dummy connector housing to a second position preventing the connector from being fitted thereto.

10. The electrical connection box according to claim 8, wherein:

said unit holder of said electrical connection box defines a unit fitting space in which the electrical-part mounted unit tightly fits, said dummy connector housing is provided adjacent to the unit holder and defines a connector fitting space in which the connector of the wire harness tightly fits, the flexible piece has a proximal end and a free end, the proximal end of the flexible piece being formed integrally with said unit holder at a location where said unit housing adjoins to said dummy connector housing, and the free end being displaced into the connector fitting space of said dummy connector housing to thereby prevent the connector from being fitted into the connector fitting space when the flexible piece is at the second position, and the flexible piece has a inclined portion on a side of the nit fitting space between the proximal end and the free end, the inclined portion projecting into the unit fitting space when the flexible piece is at the first position, and a degree of projection being larger on a free end side.

11. The electrical connection box according to claim 8, wherein:

said unit holder and said dummy connector housing are arranged adjacent to each other, said unit holder defining a unit fitting space in which the electrical-part mounted unit tightly fits, said dummy connector housing defining a connector fitting space in which the connector of the wire harness tightly fits, the unit fitting space and the connector fitting space being communicated with each other and partially overlapping one another at an overlapping apace at a location where said unit holder and said dummy connector housing adjoin to each other;

the overlapping space is occupied by a corresponding portion of the electrical-part mounted unit when the electrical-part mounted unit is fitted into the unit fitting space; and the corresponding portion of the electrical-part mounted unit forms said blocking member in cooperation with the overlapping space.

* * * * *